US008948633B2

(12) United States Patent
Sasaki et al.

(10) Patent No.: US 8,948,633 B2
(45) Date of Patent: Feb. 3, 2015

(54) WET-TYPE IMAGE FORMING APPARATUS

(71) Applicants: Kunitomo Sasaki, Takatsuki (JP); Masahiko Matsuura, Suita (JP); Takeshi Maeyama, Ikeda (JP)

(72) Inventors: Kunitomo Sasaki, Takatsuki (JP); Masahiko Matsuura, Suita (JP); Takeshi Maeyama, Ikeda (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 99 days.

(21) Appl. No.: 13/655,772

(22) Filed: Oct. 19, 2012

(65) Prior Publication Data

US 2013/0101304 A1 Apr. 25, 2013

(30) Foreign Application Priority Data

Oct. 25, 2011 (JP) ..... 2011-233726

(51) Int. Cl.
*G03G 15/00* (2006.01)
*G03G 15/10* (2006.01)

(52) U.S. Cl.
CPC ..... *G03G 15/5033* (2013.01); *G03G 15/10* (2013.01)
USPC ..... 399/49

(58) Field of Classification Search
CPC ..... G03G 15/5058; G03G 15/0189; G03G 15/5041; G03G 15/5062; G03G 15/0131
USPC ..... 399/49
See application file for complete search history.

(56) References Cited

U.S. PATENT DOCUMENTS

| | | | | |
|---|---|---|---|---|
| 5,903,800 | A * | 5/1999 | Stern et al. | 399/74 |
| 2003/0068168 | A1 * | 4/2003 | Shim et al. | 399/49 |
| 2010/0226687 | A1 | 9/2010 | Fukazawa | |

FOREIGN PATENT DOCUMENTS

| | | | |
|---|---|---|---|
| JP | 2009-015351 | A | 1/2009 |
| JP | 2010-204467 | A | 9/2010 |
| JP | 2010204469 | A | 9/2010 |

OTHER PUBLICATIONS

Machine translation of, Atsunori JP 2009-015351 A, publication date: Jan. 22, 2009.*
Machine translation of Masahiro, JP 2010-204469 A , publication date: Sep. 16, 2010.*
Machine translation of Koga, JP 2004-117666 A , publication date: Apr. 15, 2010.*
Office Action from Japanese Patent Office dated Oct. 1, 2013, issued in corresponding Japanese Patent Appln. No. 2011-233726, with English translation thereof (7 pages).

* cited by examiner

*Primary Examiner* — Walter L Lindsay, Jr.
*Assistant Examiner* — Frederick Wenderoth
(74) *Attorney, Agent, or Firm* — Buchanan Ingersoll & Rooney PC

(57) ABSTRACT

A wet-type image forming apparatus includes a density detection unit and a charge amount control unit for controlling the charge amount of toner on a liquid developer carrier. An image forming unit forms patch images while the charge amount control unit successively changes the charge amount of toner on the liquid developer carrier in a state in which a development bias is held at a prescribed value. The density detection unit detects the image density of each patch image thereby detecting a range of the charge amount of toner in which the image density of the patch image is almost saturated. The charge amount of toner in normal image formation is set to be equal to or greater than the range of the charge amount of toner in which the image density of the patch image is almost saturated.

8 Claims, 7 Drawing Sheets

WET-TYPE IMAGE FORMING APPARATUS

This application is based on Japanese Patent Application No. 2011-233726 filed with the Japan Patent Office on Oct. 25, 2011, the entire content of which is hereby incorporated by reference.

BACKGROUND OF THE INVENTION

1. Field of the Invention

The present invention relates to a wet-type image forming apparatus employing a wet-type electrophotographic technique.

2. Description of the Related Art

Image forming apparatuses employing an electrophotographic technique are widely used in the fields of facsimile machines, printers, copiers, and MFPs (Multi-Functional Peripherals). Recent image forming apparatuses are also used in the applications that require higher image quality and higher resolution, for example, such as office printers for bulk print or on-demand printers.

In recent years, in order to meet the needs of such applications, attention is focused on wet-type image forming apparatuses that use liquid developer including toner (also called toner particle) dispersed in insulating carrier liquid (see Japanese Laid-Open Patent Publication Nos. 2009-015351 and 2010-204467).

In wet-type image forming apparatuses, liquid developer drawn from a developer tank is carried on a surface of a developer carrier (developing roller). With the rotation of the developer carrier, the toner in the liquid developer carried on the developer carrier is conveyed to a development position where the developer carrier and an image carrier (photoconductor) face each other. The toner in the liquid developer carried on the developer carrier is then transferred from the surface of the developer carrier to the image carrier (photoconductor) with application of a development bias. An electrostatic latent image formed on the image carrier is developed as a toner image using the toner in the liquid developer.

The toner image on the image carrier is electrostatically transferred onto a surface such as recording paper or an intermediate transfer roller with application of a transfer bias (electrostatic transfer method). In the case where the toner image is transferred onto an intermediate transfer roller, the toner image transferred on the intermediate transfer roller is further transferred onto recording paper with application of another transfer bias.

The wet-type image forming apparatuses using liquid developer use toner particles having a small particle size when compared with dry-type image forming apparatuses. With the toner particles having a smaller particle size, fine portions of images can be expressed on recording paper. Therefore, the wet-type image forming apparatuses using liquid developer can be used to form high-quality images on recording paper.

SUMMARY OF THE INVENTION

The image density of a toner image developed in the foregoing manner depends on the magnitude of electric field applied to the charged toner at the development position. The magnitude of electric field is affected by a change in development bias, exposure energy, charge bias, or the like. Such changes thus may affect the image density of toner images, leading to degradation in image quality.

On the other hand, in a development process in the wet-type electrophotographic technique, image irregularity called granular irregularity occurs if a development bias applied to the developer carrier (developing roller) is increased and an excessive voltage is applied to the gap (development gap) between the developer carrier and the image carrier. It is known that this granular irregularity is a phenomenon that occurs when voltage is further applied after the development efficiency reaches almost 100%.

In order to stabilize the image density during image formation, it is desirable that all the toner supplied onto the developing roller should be developed (complete development should be performed). However, on the other hand, if a development potential difference is excessively increased for complete development, granular irregularity may occur to cause image noise.

The present invention aims to provide a wet-type image forming apparatus capable of forming high-quality images by preventing granular irregularity.

A wet-type image forming apparatus based on the present invention forms a toner image on an image carrier using liquid developer including toner dispersed in carrier liquid for forming an image on a transfer target member. The wet-type image forming apparatus includes: an image forming unit, including a liquid developer carrier for conveying the liquid developer carried on a surface thereof to a development portion that faces the image carrier, for forming the toner image on the image carrier by applying a development bias to the liquid developer carrier to adhere the toner in the liquid developer carried on the liquid developer carrier to the image carrier and to develop an electrostatic latent image on the image carrier using the toner; a density detection unit for detecting an image density of the toner image as a patch image formed by the image forming unit; and a charge amount control unit for controlling a charge amount of the toner on the liquid developer carrier. The image forming unit forms a plurality of the patch images while the charge amount control unit successively changes a charge amount of the toner on the liquid developer carrier in a state in which the development bias applied to the liquid developer carrier is held at a prescribed value. The density detection unit detects the image density of each of a plurality of the patch images thereby detecting a range of charge amount of the toner in which the image density of the patch image is almost saturated in a state in which the development bias is set at the prescribed value. The charge amount of the toner at a time when normal image formation is performed to form the image on the transfer target member is set to be equal to or greater than the range of charge amount of the toner in which the image density of the patch image is almost saturated.

Preferably, the wet-type image forming apparatus based on the present invention further includes a toner amount control unit for controlling a toner amount on the liquid developer carrier. When the charge amount of toner is set to be equal to or greater than the range, an initial value of the toner amount is detected in a state in which the charge amount of toner is set at a temporary value such that the image density of the patch image is saturated, and the toner amount control unit adjusts the toner amount on the liquid developer carrier from the initial value so that the image density of the patch image is almost saturated in a state in which the development bias is set at the prescribed value.

Preferably, after the charge amount of toner and the toner amount are set, the density detection unit detects the image density of the patch image having a halftone density that is formed by the image forming unit. An exposure condition in the image carrier is adjusted in accordance with the image density of the patch image having the halftone density that is detected by the density detection unit, whereby the image density of the toner image of a halftone at a time when the normal image formation is performed is set to have a desired value. Preferably, the density detection unit detects the image density of the patch image by applying light to the patch image and detecting reflection light from the patch image.

Preferably, the density detection unit detects the image density of the patch image by applying light to the patch image and detecting light transmitted through the patch image. Preferably, the density detection unit detects the image density of the patch image formed on the image carrier.

Preferably, the density detection unit detects the image density of the patch image formed on the transfer target member. Preferably, an intermediate transfer roller is arranged between the image carrier and the transfer target member, and the density detection unit detects the image density of the patch image formed on the intermediate transfer roller.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
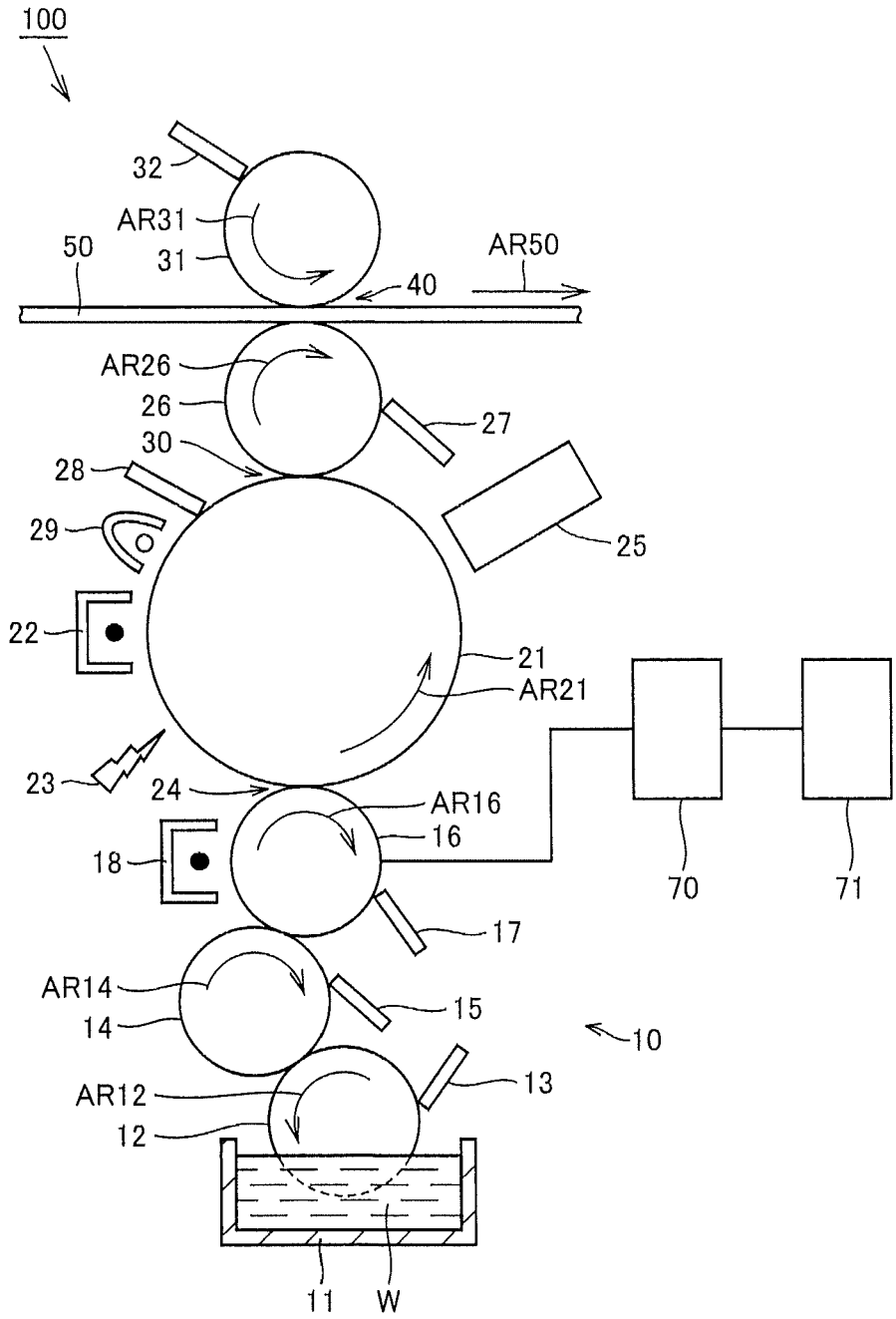
FIG. 1 is a schematic diagram showing an overall configuration of a wet-type image forming apparatus in an embodiment.

Embodiments based on the present invention will be described below with reference to the drawings. The scope of the present invention is not limited to the number or quantity specified in the description of the embodiments, if any, unless otherwise specified. In the description of the embodiments, the same or corresponding parts are denoted with the same reference numerals, and an overlapping description is not always repeated.

Embodiment (Wet-Type Image Forming Apparatus 100)

Referring to FIG. 1, an overall configuration of a wet-type image forming apparatus 100 in an embodiment will be described. As shown in FIG. 1, wet-type image forming apparatus 100 forms an image on a transfer target member such as recording paper 50. Recording paper 50 in the present embodiment is conveyed in a prescribed conveyance direction AR5 between an intermediate transfer roller 26 (detailed later) and a transfer roller 31 (detailed later).

In wet-type image forming apparatus 100, liquid developer W is supplied by a not-shown supply apparatus and stored in a developer tank 11. Liquid developer W mainly includes an insulative liquid as carrier liquid, toner for developing an electrostatic latent image, and a dispersant for dispersing the toner in the carrier liquid.

A supply roller 12 is provided in contact with liquid developer W in developer tank 11. Supply roller 12 is rotated in a direction of an arrow AR12 to cause liquid developer W to be drawn to the surface of supply roller 12. Liquid developer W is carried on the surface of supply roller 12 and conveyed toward a section where supply roller 12 and a delivery roller 14 face each other, with the rotation of supply roller 12.

Liquid developer W on the surface of supply roller 12 is passed from supply roller 12 to delivery roller 14 while the excessive developer W is scraped off by a doctor blade 13. Liquid developer W is carried on the surface of delivery roller 14 and conveyed toward a section where delivery roller 14 and a developing roller 16 (developer carrier) face each other, with the rotation of delivery roller 14 in a direction of an arrow AR14.

Liquid developer W on the surface of delivery roller 14 is thereafter passed from delivery roller 14 to developing roller 16 counter-rotating in a direction of an arrow AR16. Liquid developer W is carried on the surface of developing roller 16 and conveyed toward a development position 24, with the rotation of developing roller 16. Liquid developer W left on the surface of delivery roller 14 is removed from the surface of delivery roller 14 by a cleaning blade 15.

Through the process as described above, liquid developer W having a film thickness adjusted to be uniform in the longitudinal direction is carried on the surface of developing roller 16. Liquid developer W forms a thin layer on the surface of developing roller 16. Toner particles in liquid developer W formed in a thin layer are charged to, for example, the positive polarity by a charger 18 (charge amount control unit). A development bias power supply device 70 and a control device 71 are connected to developing roller 16. The detailed operation thereof will be described later.

A drum-like photoconductor 21 as an image carrier is provided in contact with developing roller 16. An example of photoconductor 21 includes a photoconductor made of amorphous silicon having a positively charged characteristic. Photoconductor 21 rotates in a direction of an arrow AR21. A charger 22, an exposure device 23, developing roller 16 (development position 24), a density detection unit 25, an intermediate transfer roller 26 (primary transfer section 30), a cleaning blade 28, and a neutralizer 29 (eraser lamp) are provided to surround photoconductor 21 in this order in the direction in which photoconductor 21 rotates (direction of an arrow AR21).

The surface of photoconductor 21 is uniformly charged to a prescribed surface potential V0 by charger 22. The surface of photoconductor 21 is thereafter exposed by exposure device 23 based on prescribed image information. An electrostatic latent image is formed on the surface of photoconductor 21. In the present embodiment, the potential of the electrostatic latent image is assumed as an image portion potential Vi.

Exposure device 23 in the present embodiment, which will be detailed later, has the amount of exposure, an exposure range, and an exposure timing controlled based on normal image information and is also controlled depending on values of the amount of exposure, an exposure range, an exposure timing, etc. required to form a patch image. Exposure device 23 is controlled in such a manner so that an electrostatic latent image corresponding to a patch image (detailed later) is formed on the surface of photoconductor 21.

Density detection unit 25, which is also detailed later, detects an image density of a toner image as a patch image formed on the surface of photoconductor 21 by an image forming unit (image forming unit 10). Image forming unit 10 in the present embodiment includes developing roller 16, charger 18, exposure device 23, development bias power supply device 70, and the like for forming a toner image (and patch image) on photoconductor 21.

On the other hand, a prescribed development bias is applied to developing roller 16 by development bias power supply device 70. The development potential difference formed between developing roller 16 and photoconductor 21 forms an electric field between developing roller 16 and photoconductor 21. When an electrostatic latent image is conveyed to development position 24 on photoconductor 21, the toner particles in liquid developer W carried on developing roller 16 are moved from the surface of developing roller 16 to the surface of photoconductor 21 by the effect of the electric field formed by development bias power supply device 70. Here, not only the toner particles but also the carrier liquid is adhered on the surface of photoconductor 21. The electrostatic latent image formed on the surface of photoconductor 21 is developed as a toner image (or a patch image as described later).

At this moment, the development bias applied to developing roller 16 is uniquely determined to an optimum value in a setting sequence S1 described later (see FIG. 2) and has its state kept, or is controlled to a proper value by control device 71 receiving a result of density detection by density detection unit 25 described later.

Photoconductor 21 carries a toner image formed on the surface thereof and moves the toner image to primary transfer section 30. Liquid developer W that is not transferred from developing roller 16 to photoconductor 21 but left on developing roller 16 is scraped off from the surface of developing roller 16 by a cleaning blade 17 and then recovered.

As described above, intermediate transfer roller 26 is arranged to face photoconductor 21. Intermediate transfer roller 26 rotates in a direction of an arrow AR26. Primary transfer section 30 is formed between photoconductor 21 and intermediate transfer roller 26. An electric field is formed between intermediate transfer roller 26 and photoconductor 21 with application of a prescribed transfer bias.

The toner image carried on photoconductor 21 and conveyed to first transfer unit 30 is primary-transferred from the surface of photoconductor 21 to the surface of intermediate transfer roller 26 by the effect of the electric field. The toner left on the surface of photoconductor 21 without being primary-transferred as well as contaminants on the surface of photoconductor 21 are scraped off from the surface of photoconductor 21 by cleaning blade 28 and recovered. The electric charge left on the surface of photoconductor 21 is removed by neutralizer 29.

A secondary transfer section 40 is formed between intermediate transfer roller 26 and transfer roller 31. Intermediate transfer roller 26 rotating in a direction of arrow AR26 and transfer roller 31 rotating in a direction of an arrow AR31 allow recording paper 50 to pass through secondary transfer section 40 in a conveyance direction AR50.

After the toner image is primary-transferred from the surface of photoconductor 21 to the surface of intermediate transfer roller 26 at primary transfer section 30, intermediate transfer roller 26 carries the toner image (or a patch image described later) transferred on the surface thereof and further moves the toner image toward secondary transfer section 40. An electric field is formed between intermediate transfer roller 26 and recording paper 50 with application of a prescribed transfer bias.

The toner image carried on intermediate transfer roller 26 and conveyed to secondary transfer section 40 is secondary-transferred from the surface of intermediate transfer roller 26 to the surface of recording paper 50 by the effect of the electric field. The toner left on the surface of intermediate transfer roller 26 without being secondary-transferred as well as contaminants on the surface of intermediate transfer roller 26 are scraped off from the surface of intermediate transfer roller 26 by a cleaning blade 27 and recovered.

After secondary transfer, recording paper 50 is sent to a fixing device (not shown). The toner particles in the toner image transferred on recording paper 50 are heated and pressed by the fixing device. The toner image transferred on recording paper 50 is fixed on the surface of recording paper 50 by this heat and press. Thereafter, recording paper 50 is ejected to the outside through a paper ejection device (not shown). A normal image formation operation in wet-type image forming apparatus 100 is thus completed. As for the foregoing configuration, developing roller 16 and intermediate transfer roller 26 may be formed like a roller in the present embodiment but may be formed like a belt.

(Toner Charge Amount Setting Sequence S1)

In wet-type image forming apparatus 100, a sequence S1 (see FIG. 2) for setting a toner charge amount as described below is carried out in order to prevent granular irregularity and the resultant degradation in image density when a normal image is formed on recording paper 50. In the toner charge amount setting sequence S1, the charge amount of toner included in liquid developer W is set to a prescribed value.

The toner charge amount setting sequence S1 is carried out, for example, immediately after wet-type image forming apparatus 100 is powered on, after wet-type image forming apparatus 100 forms images of a prescribed number of sheets, and/or when a prescribed time has passed since wet-type image forming apparatus 100 forms an image.

Information about the timing at which the toner charge amount setting sequence S1 is carried out is stored, for example, in a memory (not shown) connected to a main control unit (not shown) in wet-type image forming apparatus 100. The main control unit determines that a prescribed condition is satisfied, and the main control unit sends a signal for effecting the toner charge amount setting sequence S1 to each equipment that constitutes wet-type image forming apparatus 100.

Figure 2:
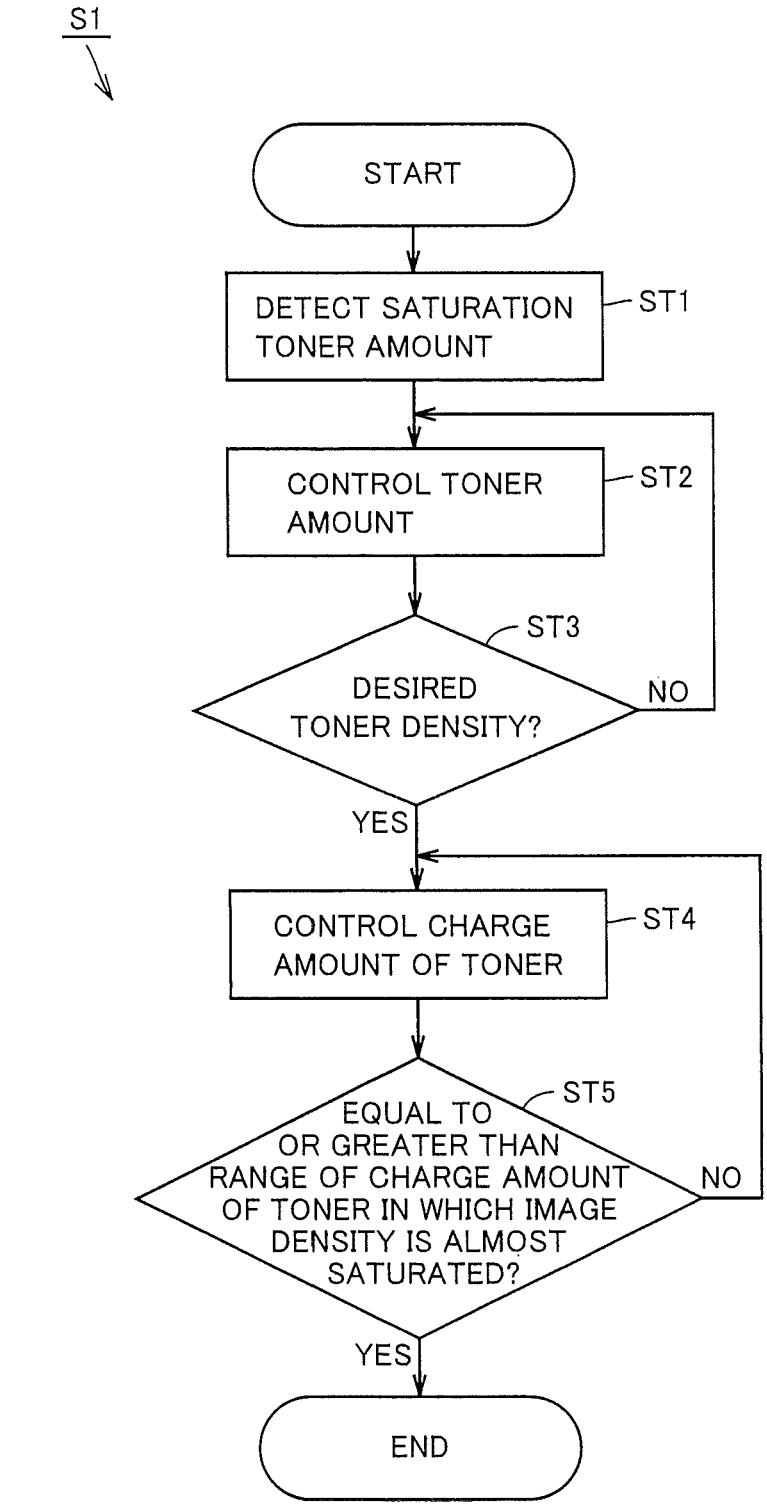
FIG. 2 is a flowchart showing that the wet-type image forming apparatus in the embodiment determines the charge amount of toner using a patch image.

Referring to FIG. 1 and FIG. 2, when the toner charge amount setting sequence is carried out, first, a control unit (not shown) connected to exposure device 23 reads out information about the amount of exposure, an exposure range, an exposure timing, etc. required to form a plurality of patch images on photoconductor 21, from a memory (not shown) connected to the control unit. Exposure device 23 controlled by the control unit based on the information successively forms a plurality of electrostatic latent images corresponding to a plurality of patch images having a halftone (half) density on photoconductor 21.

A plurality of electrostatic latent images are conveyed to development position 24. A plurality of electrostatic latent images are developed at development position 24 with a development bias applied by development bias power supply device 70. A plurality of patch images are formed on the surface of photoconductor 21 at a portion downstream from development position 24 and upstream from primary transfer section 30.

Figure 3:
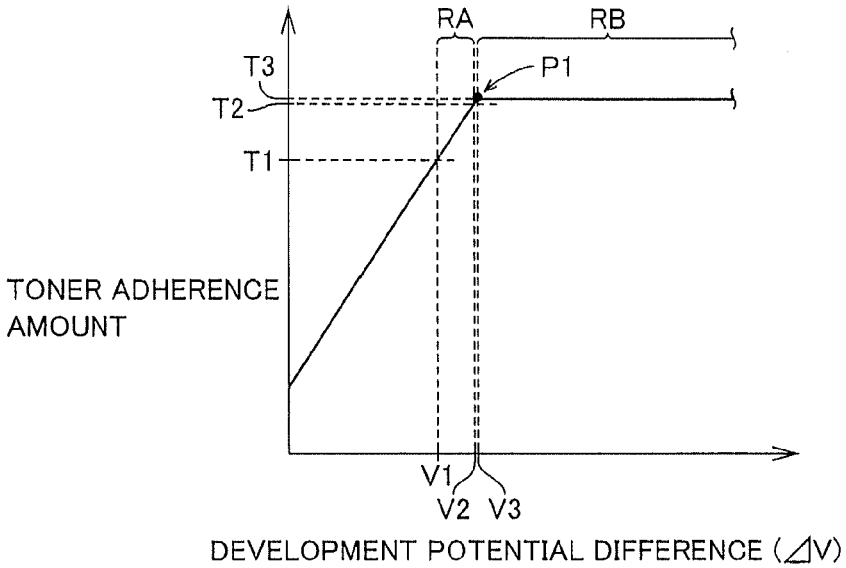
FIG. 3 is a diagram showing the relation between the amount of toner adherence and the magnitude of development potential difference between an image carrier and a developer carrier at a development position.

FIG. 3 is a diagram showing the changing amount of adherence of toner to photoconductor 21 with respect to the development potential difference formed between developing roller 16 and photoconductor 21. For example, when the development potential difference ΔV is increased from V1 to V2 with increasing development bias Vb, the intensity of the generated electric field is increased accordingly. Thus, the amount of toner adherence to photoconductor 21 from developing roller 16 increases from T1 to T2.

The amount of toner adherence to photoconductor 21 from developing roller 16 is almost saturated at the time when the development potential difference ΔV reaches V2. The amount of toner adherence is saturated at T3 in a range (a range RB after a point of inflection P1) equal to or higher than the development potential difference ΔV shown by V3. The image density of the toner image formed in this range RB hardly changes even when the image forming conditions such as a development bias Vb, a charge bias, and exposure energy vary to some extent.

Here, "the amount of toner adherence is almost saturated" means that the amount of toner that contributes to development of an electrostatic latent image hardly changes even when the development potential difference ΔV varies, including the case where all the toner included in liquid developer W on developing roller 16 is adhered onto photoconductor 21, as a matter of course, and the case where toner at a prescribed ratio (for example, 90% or 95%) in liquid developer W on developing roller 16 hardly changes in a state of being adhered on photoconductor 21 even when the development potential difference ΔV changes with characteristic changes of photoconductor 21 and other rollers.

Referring to FIG. 1 and FIG. 2 again, a plurality of patch images formed on photoconductor 21 are moved toward the section where density detection unit 25 and photoconductor 21 face each other, with the rotation of photoconductor 21. When a plurality of patch images successively pass through a detection range of density detection unit 25, density detection unit 25 detects an image density of each of a plurality of patch images. When a patch image with the image density saturated is detected, density detection unit 25 detects the amount of toner included in that patch image as a saturation toner amount (sequence ST1). Here, the charge amount of toner is set low in advance so that the development toner amount reaches the saturation amount in a state in which the development bias is held at a prescribed value. In a situation in which the image density of the patch image is not saturated, the charge amount of toner is gradually changed to a low value discretely or continuously so that the image density of the patch image can be saturated.

Figure 4:
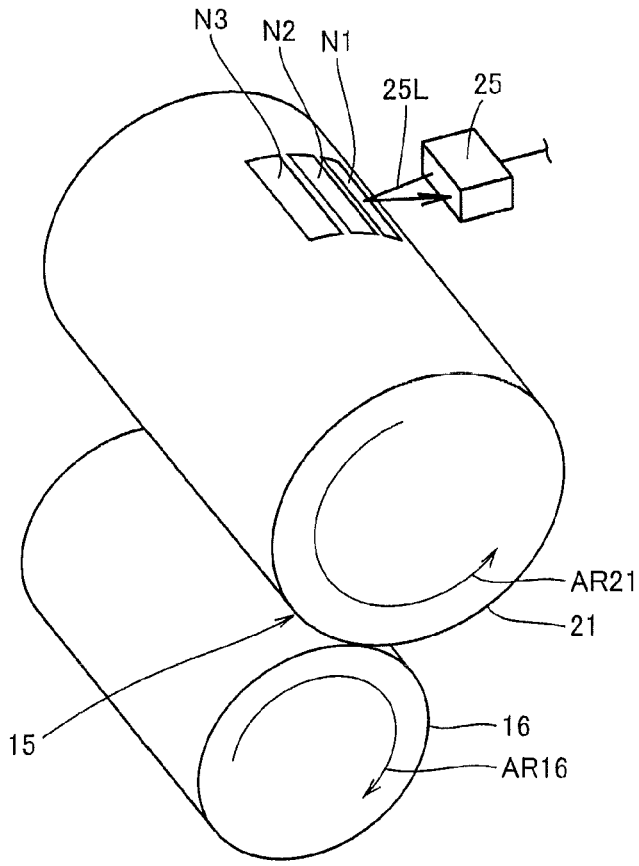
FIG. 4 is a perspective view showing that a density detection unit for use in the wet-type image forming apparatus in the embodiment detects an image density of a patch image.

As shown in FIG. 4, density detection unit 25 may be configured as an optical sensor having a light emitting and a light receiving unit for detecting the image density of a patch image. Laser light 25L applied from density detection unit 25 is reflected at patch images N1 to N3, so that density detection unit 25 detects the reflection light thereof. Density detection unit 25 can detect the image density of the patch image, for example, based on the intensity of reflection light. FIG. 4 shows the light emitting unit and the light receiving unit that are integrally configured. However, they may be configured as separate units.

In the case described above, density detection unit 25 is arranged to face photoconductor 21, and density detection unit 25 detects the image density of a patch image on photoconductor 21. However, density detection unit 25 may detect the image density of a patch image transferred onto intermediate transfer roller 26 from photoconductor 21.

Figure 5:
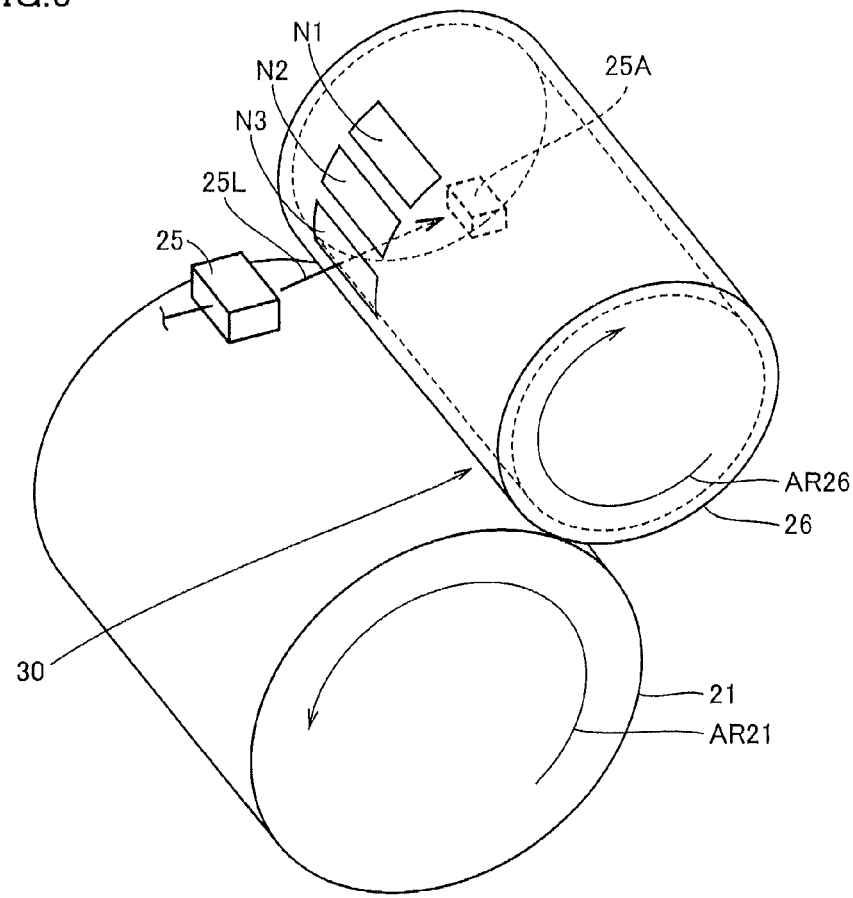
FIG. 5 is a perspective view showing that another density detection unit for use in the wet-type image forming apparatus in the embodiment detects an image density of a patch image.

Referring to FIG. 5, in this case, intermediate transfer roller 26 may be entirely or partially formed of a transparent member. Laser light 25L is applied from density detection unit 25 toward each of patch images N1 to N3. A light receiving unit 25A arranged on the opposite side with each of patch images N1 to N3 interposed therebetween detects light transmitted through patch images N1 to N3. Density detection unit 25 can detect the image density of the patch image, for example, based on the intensity of transmitted light.

Figure 6:
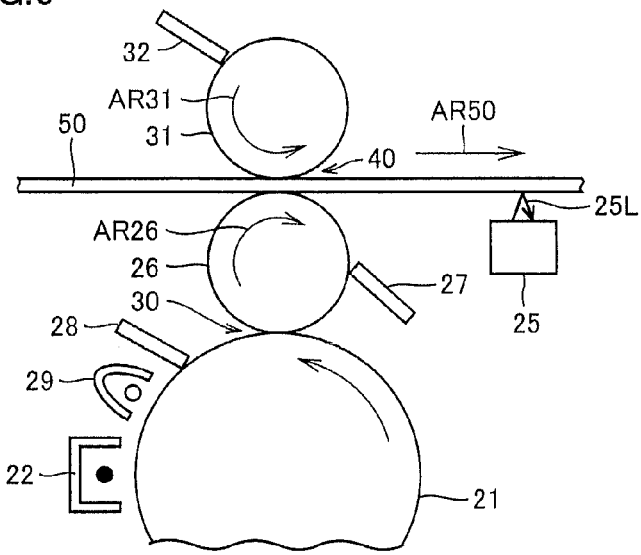
FIG. 6 is a schematic view showing that yet another density detection unit for use in the wet-type image forming apparatus in the embodiment detects an image density of a patch image.

Referring to FIG. 6, density detection unit 25 may detect the image density of a patch image transferred onto recording paper 50 (transfer target member) from intermediate transfer roller 26. In this case, as shown in FIG. 6, density detection unit 25 is arranged to face recording paper 50 located downstream from secondary transfer section 40. Density detection unit 25 can detect the image density of the patch image, for example, based on the intensity of reflection light from recording paper 50.

Referring to FIG. 2 again, after density detection unit 25 detects the amount of toner in which the image density is saturated, if the toner in liquid developer W that forms a patch image is shifted from the desired toner density, the toner amount may be controlled at that point of time, if necessary (sequences ST2, ST3).

In order to control the toner amount, the peripheral speed ratio of supply roller 12, delivery roller 14, and developing roller 16 is changed because the amount of liquid developer W passed to developing roller 16 is proportional to the peripheral speed ratio of supply roller 12 and delivery roller 14. The toner amount is thus easily adjusted. In other words, when the toner amount on developing roller 16 is adjusted by changing the peripheral speed ratio of supply roller 12, delivery roller 14, and developing roller 16, supply roller 12 and delivery roller 14 correspond to the toner amount control unit. When one of supply roller 12 and delivery roller 14 is used to change the peripheral speed ratio to developing roller 16, that one corresponds to the toner amount control unit.

Figure 7:
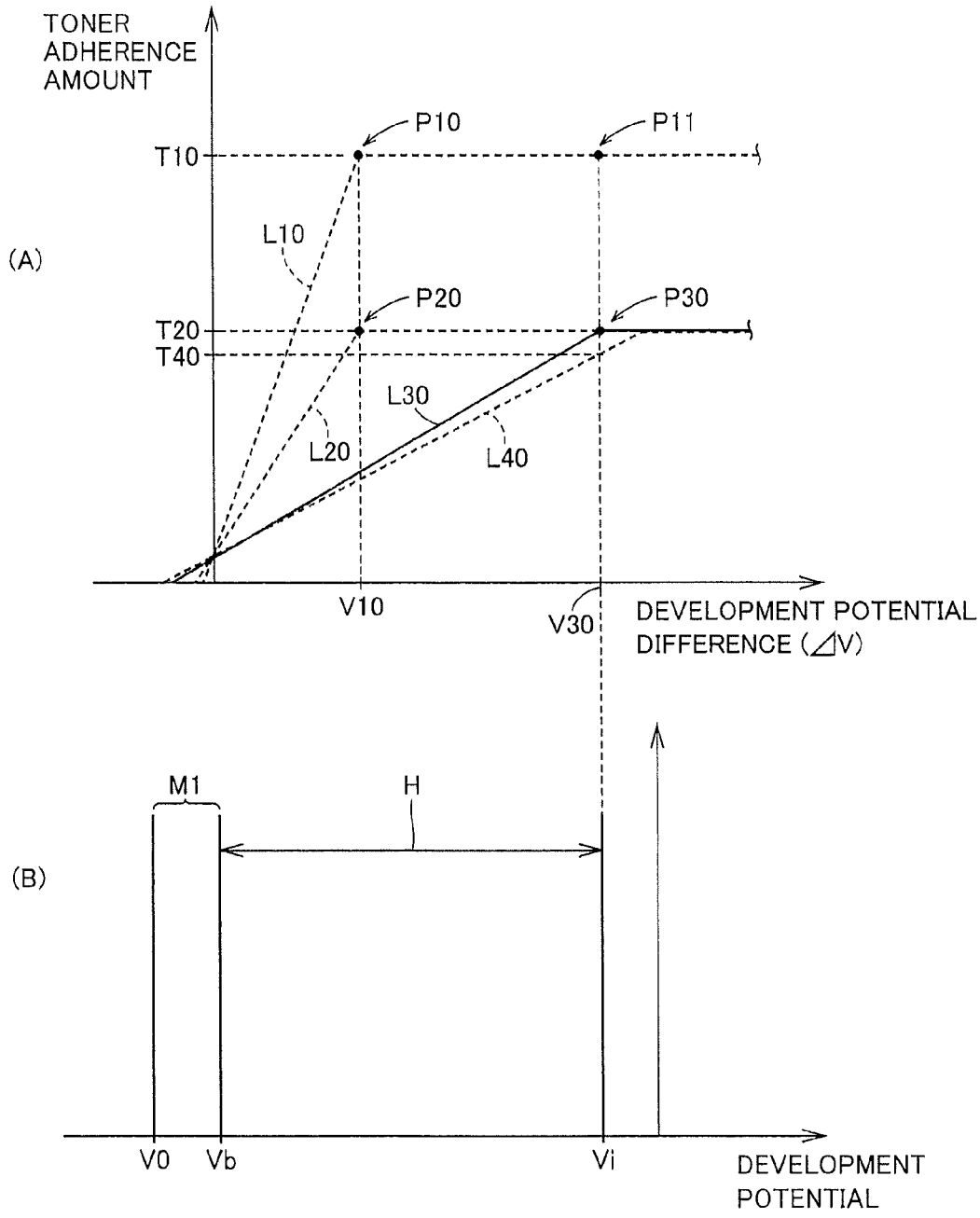
FIG. 7 is a diagram showing the relation between the amount of adherence of toner for forming a patch image and the magnitude of development potential difference between the image carrier and the developer carrier when the wet-type image forming apparatus in the embodiment determines the charge amount of toner using a patch image.

Here, referring to FIG. 2 and FIG. 7(A), (B), after the toner amount is detected as an initial value (after sequence ST1), the toner amount is controlled by sequences ST2 and ST3, so that the amount of toner adhered on photoconductor 21 for forming a patch image is decreased from T10 to T20. As described above, when the saturation value of the development characteristic is reached, the amount of toner adherence is uniquely determined by the toner amount in the thin layer (liquid developer W) formed on developing roller 16 in the thin layer formation process from supply roller 12 to developing roller 16 described above.

Therefore, as a result of controlling the toner amount, the development characteristic L10 having a point of inflection P10 when the development potential difference ΔV is V10 with the amount of adherence of T10 changes to the development characteristic L20 having a point of inflection P20 when the development potential difference ΔV is V10 with the amount of adherence of T20. In the present embodiment, the development bias is held at a prescribed value, whereby the development potential difference ΔV is kept constant at a value of V30 (fixed value). In the development characteristic L10 in which the amount of adherence is T10, when the development potential difference ΔV is V30, the amount of toner adherence is saturated as shown by a point P11.

Then, in sequences ST4 and ST5 shown in FIG. 2, the charge amount of toner that forms a patch image is controlled by charger 18 arranged to face developing roller 16. While charger 18 successively changes (increases) the charge amount of toner on developing roller 16, image forming unit 10 (developing roller 16 and the like) forms a plurality of patch images on photoconductor 21. When the charge amount of toner is changed so as to successively increase, as the development characteristic of each of a plurality of patch images, for example, the development characteristic as shown by development characteristic L20 in FIG. 7(A) gradually approaches the development characteristic shown by development characteristic L30 in FIG. 7(A).

When the charge amount of toner is changed so as to further increase, the patch image in this case has a development characteristic, for example, as shown by development characteristic L40 in FIG. 7(A). The charge amount of toner set for forming a patch image having development characteristic L40 is greater than the charge amount of toner set for forming a patch image having development characteristic L30. The patch image having development characteristic L40 is the image developed on photoconductor 21 with the toner adherence amount T40 under the effect of an electric field by development potential difference V30. The toner adherence amount T40 has a value smaller than the toner adherence amount T20. Here, it is assumed that the toner adherence amount T40 is almost saturated as the image density (toner adherence amount) of a patch image.

Specifically, density detection unit 25 detects the image density of each of a plurality of patch images formed on photoconductor 21 (or intermediate transfer roller 26 or recording paper 50), thereby detecting the range of the charge amount of toner (in the present embodiment, the range from the value of the charge amount of toner at a time when the patch image has development characteristic L30 in FIG. 7(A) to the value of the charge amount of toner at a time when the patch image has development characteristic L40 in FIG. 7(A)) in which the image density (toner adherence amount) of the patch image is almost saturated, in a state in which the development bias is set at a prescribed value (in the present embodiment, development potential difference V30 in FIG. 7(A)).

As described above, "the image density (toner adherence amount) of a patch image is almost saturated" referred to here means that the amount of toner that contributes to development of an electrostatic latent image hardly changes even when development potential difference ΔV varies, including the case where all the toner included in liquid developer W on developing roller 16 is adhered onto photoconductor 21, as a matter of course, and the case where toner at a prescribed ratio (for example, 90% or 95%) in liquid developer W on developing roller 16 hardly changes in a state of being adhered on photoconductor 21 even when the development potential difference ΔV changes with characteristic changes of photoconductor 21 and other rollers, as shown by the range RA in FIG. 3.

After the range of the charge amount of toner (in the present embodiment, the range from the value of the charge amount of toner at a time when the patch image has development characteristic L30 in FIG. 7(A) to the value of the charge amount of toner at a time when the patch image has development characteristic L40 in FIG. 7(A)) in which the image density (toner adherence amount) of the patch image is almost saturated is detected by successively changing (increasing) the charge amount of toner, wet-type image forming apparatus 100 sets the charge amount of toner for use in normal image formation to be equal to or greater than the range of the charge amount of toner in which the image density of a patch image is almost saturated.

In other words, when the charge amount of toner is increased, the slope of the development efficiency with respect to development potential difference ΔV becomes gentle, and development characteristic L20 successively change to development characteristic L30 and development characteristic L40. This is because toner charged to the same polarity as development bias Vb is adhered to the portion where an electrostatic latent image is formed on the surface of photoconductor 21, thereby compensating for (cancelling) the static image potential.

As described above, in order to stabilize the density of an image during normal image formation, it is desirable that all the toner supplied onto developing roller 16 should be developed (completely developed). On the other hand, if development potential difference ΔV is excessively increased for complete development, granular irregularity may occur to cause image noise.

In the case where an electrostatic latent image having a halftone (half) density is to be developed accurately, the slope of the development characteristic is preferably gradual (the rate of change is preferably small). In other words, as shown in FIG. 7(B), the width H between development bias Vb and image portion potential Vi is preferably as wide as possible. This is because the effect of variations of development potential difference ΔV is reduced if the development efficiency is gradual (if the rate of change is small) even when development potential difference ΔV varies to some extent.

In order to prevent toner from being adhered to a region other than the image portion (which is called fog), a potential difference of the same polarity as the charge of toner is set as a fog margin M1 (the difference between photoconductor surface potential V0 and image portion potential Vi) for a non-image portion. The maximum values of surface potential V0 of photoconductor 21 and development bias Vb are uniquely determined by the characteristics of photoconductor 21. When the charge amount of toner is excessively increased, the capacity limit of photoconductor 21 is exceeded, and discharge starts on the surface of photoconductor 21. Thus, 100% development becomes impossible.

With all things considered, wet-type image forming apparatus 100 in the present embodiment controls the charge amount of toner so that development characteristic L20 having a point of inflection P20 when development potential difference ΔV is V10 with the adherence amount of T20 is changed to development characteristic L30 having a point of inflection P30 when development potential difference ΔV is V30 (the value of development bias set in the present embodiment), and further changed to development characteristic L40 having the toner adherence amount T40 almost saturated when development potential difference ΔV is V30 with the adherence amount of T20. Accordingly, the range of the charge amount of toner in which the image density (toner adherence amount) of the patch image is almost saturated is detected. Here, development characteristic L40 is a critical point of the range in which the amount of toner adherence is almost saturated in the case where development potential difference ΔV is V30.

Then, the charge amount of toner for use in normal image formation is set to be equal to or greater than the range of the charge amount of toner in which the image density of the patch image is almost saturated. The lower limit of the range of the charge amount of toner in which the image density of the patch image is almost saturated is the charge amount of toner at the time when development characteristic L30 having a point of inflection P30 is formed. Preferably, the upper limit of the range of the charge amount of toner in which the image density of the patch image is almost saturated is set as the charge amount of toner at the time when development characteristic L40 having the toner adherence amount T40 almost saturated when development potential difference ΔV is V30 is formed. As described above, development characteristic L40 is the critical point of the range in which the adherence amount of toner is almost saturated in the case where development potential difference ΔV is V30.

In order to control the charge amount of toner, for example, a patch image may be formed while current fed to developing roller 16 is successively changed discretely (or continuously). The information of the image density of the patch image that is detected by density detection unit 25 is fed back to image forming unit 10. In order to control the charge amount of toner, the potential of the toner layer may be directly measured, and the output of charger 18 may be controlled based on the measurement result.

Figure 8:
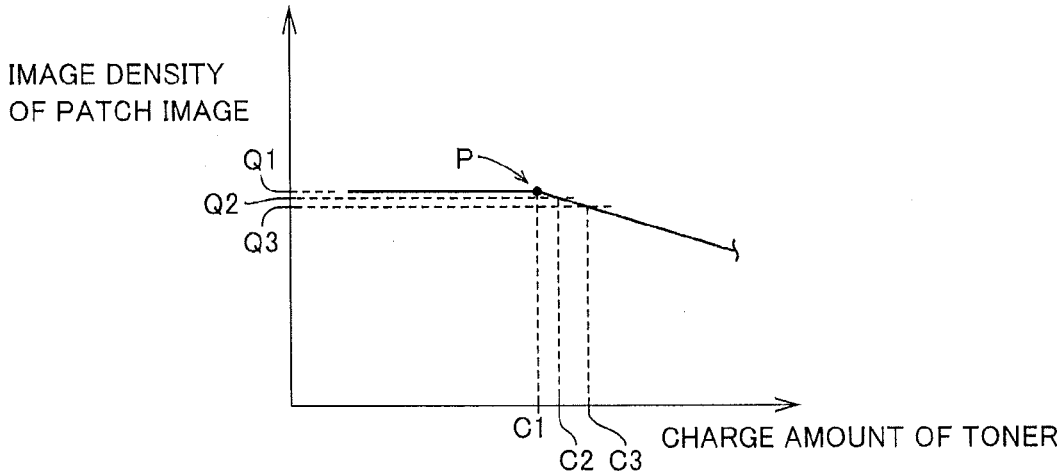
FIG. 8 is a diagram showing the relation between the charge amount of toner and the image density of a patch image when the wet-type image forming apparatus in the embodiment determines the charge amount of toner using a patch image.

Referring to FIG. 8, when the charge amount of toner is low (charge amount <C1), the development efficiency is saturated at a density Q1 with the set development bias Vb, and the image density of the patch image does not change. By increasing the charge amount of toner, the slope of the development characteristic becomes gentle with respect to development potential difference ΔV, and, at some point, a patch image having a density lower than the saturated density appears (in other words, a point of inflection P of the development characteristic is detected). The setting toner charge amount is set in the vicinity of this point (for example, the charge amounts C2 to C3 corresponding to the range of Q2=Q1×95% to Q3=Q1×90% with respect to the density Q1 when saturated), resulting in the development characteristic for obtaining stable and good toner images without granular irregularity as described above.

(Operation and Effects)

As described above, in wet-type image forming apparatus 100 in the present embodiment, the charge amount of toner is set through setting sequences ST1 to ST5 described above. This prevents granular irregularity due to application of an excessive voltage and allows image formation under the development conditions that stabilize the image density. When the image density during printing in progress is detected, if the actual toner amount is shifted from the setting toner amount, the charge amount of toner is set again through the setting sequences ST1 to ST5 described above.

[Modification]

Figure 9:
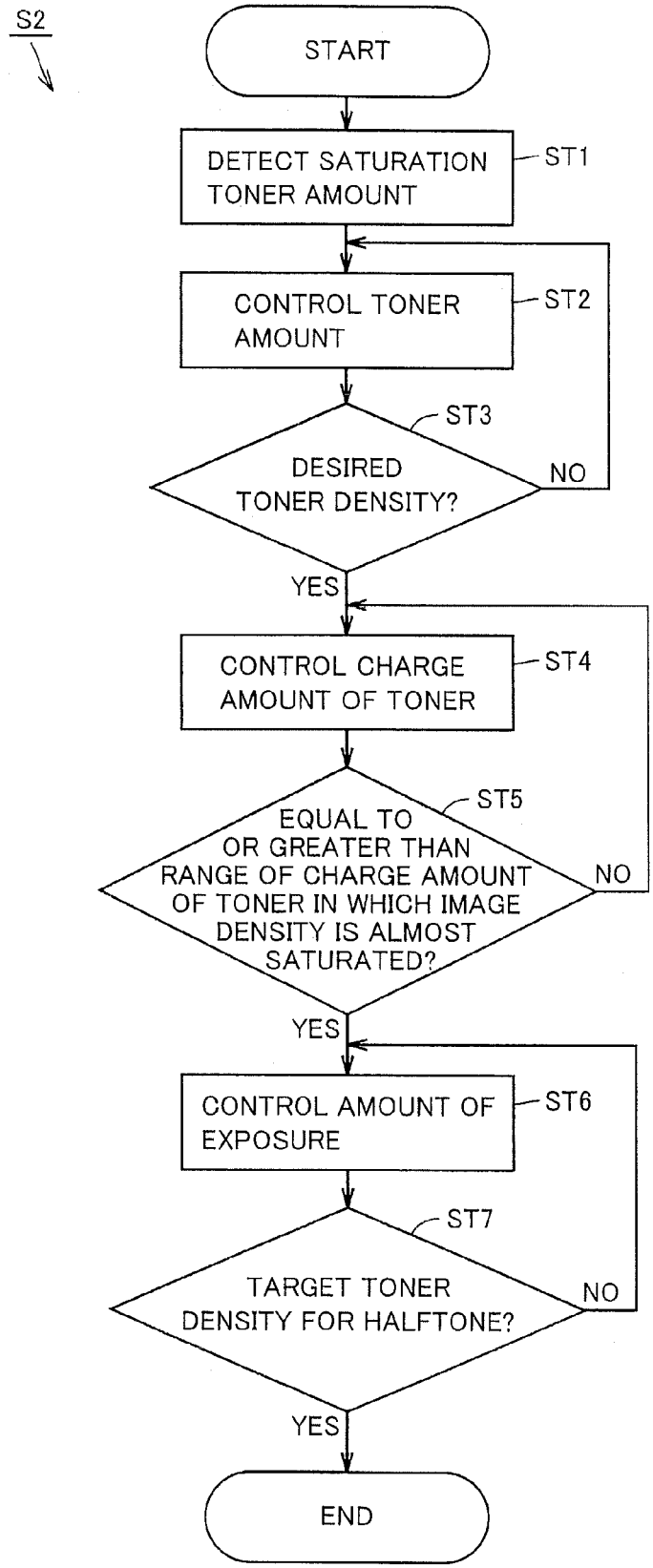
FIG. 9 is a flowchart showing that the wet-type image forming apparatus in a modified embodiment determines the charge amount of toner using a patch image and sets the image density of a halftone toner image to a desired value by adjusting exposure conditions.

In a case where an image of a halftone (half) density is adjusted as in the toner charge amount setting sequence S2 shown in FIG. 9, the exposure condition (the amount of exposure) is controlled. In this case, first, the amount of toner is controlled in a similar manner as in the foregoing embodiment. Thereafter (after sequence ST1), the charge amount of toner is adjusted whereby the development characteristic is adjusted (sequences ST2 to ST5).

Thereafter, as shown by sequences ST6 and ST7, the amount of exposure is adjusted so that a toner image in a halftone achieves a target density. In a similar manner as in the case where the saturation toner amount is controlled as described above, when the image density during printing in progress is detected, if the actual toner amount is shifted from the setting toner amount for a halftone, the amount of exposure is adjusted again through setting sequences ST1 to ST5 described above.

In the foregoing embodiment and modification, an appropriate margin may be set for the development potential difference, considering the case where development potential difference ΔV varies due to various errors and becomes higher than a point of inflection, resulting in granular irregularity. Specifically, after adjustment to the optimum development characteristic through setting sequences ST1 and ST2 above, the development potential difference is set lower than the point of inflection of the development characteristic, for example, using control device 71. Here, the optimum development characteristic is a state in which the slope is gradual to maximum within the system permissible range. Therefore, granular irregularity can be prevented while further preventing density variations.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A wet-type image forming apparatus for forming a toner image on an image carrier using liquid developer including toner dispersed in carrier liquid for forming an image on a transfer target member, comprising:

an image forming unit, including a liquid developer carrier for conveying said liquid developer carried on a surface thereof to a development portion that faces said image carrier, for forming said toner image on said image carrier by applying a development bias to said liquid developer carrier to adhere said toner in said liquid developer carried on said liquid developer carrier to said image carrier and to develop an electrostatic latent image on said image carrier using said toner;

a density detection unit for detecting an image density of said toner image as a patch image formed by said image forming unit; and a charge amount control unit for controlling a charge amount of said toner on said liquid developer carrier, wherein said image forming unit forms a plurality of patch images, and for each successive patch image, said charge amount control unit changes a charge amount of said toner on said liquid developer carrier in a state in which said development bias applied to said liquid developer carrier is maintained at a prescribed value, said density detection unit detects a respective image density of each successive patch image from the plurality of patch images thereby detecting a range of charge amount of said toner, said range including at least a charge amount in which said image density of one patch image is almost saturated in a state in which said development bias applied to said liquid developer carrier is set at said prescribed value and a charge amount in which said image density of another patch image is saturated, and the charge amount of said toner at a time when normal image formation is performed to form said image on said transfer target member is set to be equal to or greater than said range of charge amount of said toner in which said image density of said patch image is almost saturated.

2. The wet-type image forming apparatus according to claim 1, further comprising a toner amount control unit for controlling a toner amount on said liquid developer carrier, wherein when said charge amount of toner is set to be equal to or greater than said range, an initial value of said toner amount is detected in a state in which said charge amount of toner is set at a temporary value such that said image density of said patch image is saturated, and said toner amount control unit adjusts said toner amount on said liquid developer carrier from said initial value so that said image density of said patch image is almost saturated in a state in which said development bias is set at said prescribed value.

3. The wet-type image forming apparatus according to claim 2, wherein after said charge amount of toner and said toner amount are set, said density detection unit detects said image density of said patch image having a halftone density that is formed by said image forming unit, and an exposure condition in said image carrier is adjusted in accordance with said image density of said patch image having said halftone density that is detected by said density detection unit, whereby said image density of said toner image of a halftone at a time when said normal image formation is performed is set to have a desired value.

4. The wet-type image forming apparatus according to claim 1, wherein said density detection unit detects said image density of said patch image by applying light to said patch image and detecting reflection light from said patch image.

5. The wet-type image forming apparatus according to claim 1, wherein said density detection unit detects said image density of said patch image by applying light to said patch image and detecting light transmitted through said patch image.

6. The wet-type image forming apparatus according to claim 1, wherein said density detection unit detects said image density of said patch image formed on said image carrier.

7. The wet-type image forming apparatus according to claim 1, wherein said density detection unit detects said image density of said patch image formed on said transfer target member.

8. The wet-type image forming apparatus according to claim 1, wherein an intermediate transfer roller is arranged between said image carrier and said transfer target member, and said density detection unit detects said image density of said patch image formed on said intermediate transfer roller.

* * * * *